US008955736B2

(12) United States Patent
Spivey, Sr. et al.

(10) Patent No.: US 8,955,736 B2
(45) Date of Patent: Feb. 17, 2015

(54) CARTON WITH HANDLE

(71) Applicant: Graphic Packaging International, Inc., Atlanta, GA (US)

(72) Inventors: Raymond R. Spivey, Sr., Mableton, GA (US); Jean-Manuel Gomes, Acworth, GA (US); Mark Zammit, Hiram, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 115 days.

(21) Appl. No.: 13/758,091

(22) Filed: Feb. 4, 2013

(65) Prior Publication Data

US 2013/0214036 A1 Aug. 22, 2013

Related U.S. Application Data

(60) Provisional application No. 61/633,709, filed on Feb. 16, 2012.

(51) Int. Cl.
*B65D 5/46* (2006.01)
*B31B 1/86* (2006.01)
(Continued)

(52) U.S. Cl.
CPC ..... *B65D 5/46096* (2013.01); *B65D 5/542* (2013.01); *B31B 1/86* (2013.01); *B31B 1/62* (2013.01); *B31B 1/72* (2013.01); *B31B 1/25* (2013.01); *B31B 1/90* (2013.01); *B65D 5/46192* (2013.01)
USPC ..... 229/117.12; 229/242; 493/88; 493/128

(58) Field of Classification Search
CPC ..... B65D 2571/00469; B65D 2571/00518; B65D 2571/00524; B65D 2571/00549; B65D 2571/00462; B65D 2571/00574; B65D 5/46192; B65D 2571/00839
USPC ..... 229/201, 920; 493/88; 206/200, 428, 206/141
See application file for complete search history.

(56) References Cited

U.S. PATENT DOCUMENTS 1,253,193 A 1/1918 Hill
2,383,183 A 8/1945 Fishcher
(Continued)

FOREIGN PATENT DOCUMENTS

CA 877792 8/1971
CA 2 160 145 9/1995
(Continued)

OTHER PUBLICATIONS

International Search Report and Written Opinion for PCT/US2013/024581 dated May 15, 2013.

*Primary Examiner* — Christopher Demeree
(74) *Attorney, Agent, or Firm* — Womble Carlyle Sandridge & Rice, LLP

(57) ABSTRACT

A carton for containing a plurality of articles. The carton comprises a plurality of panels that extends at least partially around an interior of the carton. The plurality of panels comprises a first top panel, a second top panel, a bottom panel, a first side panel, and a second side panel. The first top panel and the second top panel are at least partially overlapped to form a top wall of the carton. A handle extends in at least the top wall. The handle can comprise at least a first handle portion of the first top panel and a second handle portion of the second top panel. The first handle portion can at least partially overlap the second handle portion at a rounded corner of the carton.

39 Claims, 8 Drawing Sheets

(51) Int. Cl.

| | |
|---|---|
| ***B65D 5/54*** | (2006.01) |
| ***B31B 1/62*** | (2006.01) |
| ***B31B 1/72*** | (2006.01) |
| ***B31B 1/25*** | (2006.01) |
| ***B31B 1/90*** | (2006.01) |

(56) References Cited

U.S. PATENT DOCUMENTS

| | | | |
|---|---|---|---|
| 2,594,376 | A | 4/1952 | Arneson |
| 2,702,144 | A | 2/1955 | Forrer |
| 2,797,856 | A | 7/1957 | Jaeschke |
| 2,810,506 | A | 10/1957 | Kessler |
| 2,819,506 | A | 10/1957 | Kessler |
| 2,868,433 | A | 1/1959 | Anderson, Jr. |
| 2,955,739 | A | 10/1960 | Collura |
| 3,112,856 | A | 12/1963 | MacIntosh et al. |
| 3,127,720 | A | 4/1964 | Gentry et al. |
| 3,204,814 | A | 9/1965 | Mahon |
| 3,204,815 | A | 9/1965 | Weis |
| 3,309,005 | A | 3/1967 | Pilger |
| 3,334,767 | A | 8/1967 | Cornelius et al. |
| 3,355,012 | A | 11/1967 | Weiss |
| 3,381,881 | A | 5/1968 | Granz et al. |
| 3,828,926 | A | 8/1974 | Rossi |
| 3,886,901 | A | 6/1975 | Zeitter |
| 3,894,681 | A | 7/1975 | Arneson et al. |
| 3,904,036 | A | 9/1975 | Forrer |
| 3,933,303 | A | 1/1976 | Kirby, Jr. |
| 3,994,432 | A | 11/1976 | Kirby, Jr. |
| 4,029,204 | A | 6/1977 | Manizza |
| 4,036,423 | A | 7/1977 | Gordon |
| 4,096,985 | A | 6/1978 | Wood |
| 4,111,306 | A | 9/1978 | Roccaforte |
| 4,216,861 | A | 8/1980 | Oliff |
| 4,318,474 | A | 3/1982 | Hasegawa |
| 4,328,923 | A | 5/1982 | Graser |
| 4,329,923 | A | 5/1982 | Iida |
| 4,331,289 | A | 5/1982 | Killy |
| 4,364,509 | A | 12/1982 | Holley et al. |
| 4,375,258 | A | 3/1983 | Crayne et al. |
| 4,378,905 | A | 4/1983 | Roccaforte |
| 4,382,505 | A | 5/1983 | Sutherland et al. |
| 4,396,143 | A | 8/1983 | Killy |
| 4,418,864 | A | 12/1983 | Nielsen |
| 4,424,901 | A | 1/1984 | Lanier |
| 4,436,244 | A | 3/1984 | Morris |
| 4,440,340 | A | 4/1984 | Bakx |
| 4,470,503 | A | 9/1984 | Stone |
| 4,478,334 | A | 10/1984 | Graser |
| 4,498,619 | A | 2/1985 | Roccaforte |
| 4,508,258 | A | 4/1985 | Graser |
| 4,538,759 | A | 9/1985 | Dutcher |
| 4,545,485 | A | 10/1985 | Oliff |
| 4,546,914 | A | 10/1985 | Roccaforte |
| 4,577,799 | A | 3/1986 | Oliff |
| 4,588,084 | A | 5/1986 | Holley, Jr. |
| 4,653,686 | A | 3/1987 | Wood et al. |
| 4,706,876 | A | 11/1987 | Wilson |
| 4,747,487 | A | 5/1988 | Wood |
| 4,747,534 | A | 5/1988 | Marie |
| 4,784,266 | A | 11/1988 | Chaussadas |
| 4,784,316 | A | 11/1988 | Crouch |
| 4,802,583 | A | 2/1989 | Calvert et al. |
| 4,830,267 | A | 5/1989 | Wilson |
| 4,875,586 | A | 10/1989 | Chaussadas |
| 4,966,324 | A | 10/1990 | Steel |
| 5,020,337 | A | 6/1991 | Krieg |
| 5,060,792 | A | 10/1991 | Oliff |
| 5,072,876 | A | 12/1991 | Wilson |
| 5,094,359 | A | 3/1992 | DeMars et al. |
| 5,106,014 | A | 4/1992 | Miller |
| 5,119,985 | A | 6/1992 | Dawson et al. |
| 5,197,598 | A | 3/1993 | Stout et al. |
| 5,221,041 | A | 6/1993 | Stout et al. |
| 5,222,658 | A | 6/1993 | DeMaio et al. |
| 5,234,102 | A | 8/1993 | Schuster et al. |
| 5,246,112 | A | 9/1993 | Stout et al. |
| 5,284,294 | A | 2/1994 | Floyd |
| 5,292,058 | A | 3/1994 | Zoss et al. |
| 5,297,725 | A | 3/1994 | Sutherland |
| 5,303,863 | A | 4/1994 | Arasim |
| 5,307,932 | A | 5/1994 | Stout et al. |
| 5,307,986 | A | 5/1994 | Schuster |
| 5,320,277 | A | 6/1994 | Stout et al. |
| 5,328,081 | A | 7/1994 | Saulas |
| 5,333,734 | A | 8/1994 | Stout et al. |
| D350,480 | S | 9/1994 | Sutherland |
| 5,379,944 | A | 1/1995 | Stout et al. |
| 5,381,891 | A | 1/1995 | Harris |
| 5,385,234 | A | 1/1995 | Stout et al. |
| 5,395,044 | A | 3/1995 | Stout |
| 5,427,241 | A | 6/1995 | Sutherland |
| 5,458,234 | A | 10/1995 | Harris |
| 5,472,090 | A | 12/1995 | Sutherland |
| 5,472,136 | A | 12/1995 | Roccaforte |
| 5,485,915 | A | 1/1996 | Harris |
| 5,495,727 | A | 3/1996 | Strong et al. |
| 5,524,756 | A | 6/1996 | Sutherland |
| 5,551,556 | A | 9/1996 | Sutherland |
| 5,582,343 | A | 12/1996 | Dalvey |
| 5,639,017 | A | 6/1997 | Fogle |
| 5,647,483 | A | 7/1997 | Harris |
| 5,669,500 | A | 9/1997 | Sutherland |
| 5,699,957 | A | 12/1997 | Bin et al. |
| 5,704,470 | A | 1/1998 | Sutherland |
| 5,738,273 | A | 4/1998 | Auclair |
| 5,739,273 | A | 4/1998 | Engelman et al. |
| 5,794,778 | A | 8/1998 | Harris |
| 5,826,782 | A | 10/1998 | Stout |
| 5,873,515 | A | 2/1999 | Dunn et al. |
| 5,878,946 | A | 3/1999 | Frerot et al. |
| 5,906,313 | A | 5/1999 | Oliff |
| 5,915,546 | A | 6/1999 | Harrelson |
| 5,992,733 | A | 11/1999 | Gomes |
| 6,019,276 | A | 2/2000 | Auclair |
| 6,021,897 | A | 2/2000 | Sutherland |
| 6,065,590 | A | 5/2000 | Spivey |
| 6,085,969 | A | 7/2000 | Burgoyne |
| 6,105,853 | A | 8/2000 | Lamare |
| 6,105,854 | A | 8/2000 | Spivey et al. |
| 6,112,977 | A | 9/2000 | Sutherland et al. |
| 6,129,266 | A | 10/2000 | Oliff et al. |
| 6,131,803 | A | 10/2000 | Oliff et al. |
| 6,164,526 | A | 12/2000 | Dalvey |
| 6,170,741 | B1 | 1/2001 | Skolik et al. |
| 6,202,920 | B1 | 3/2001 | Auclair |
| 6,227,367 | B1 | 5/2001 | Harrelson et al. |
| 6,260,755 | B1 | 7/2001 | Bates et al. |
| 6,302,320 | B1 | 10/2001 | Stout |
| D452,154 | S | 12/2001 | Rhodes et al. |
| 6,371,365 | B1 | 4/2002 | Doucette et al. |
| 6,425,520 | B1 | 7/2002 | Peterson |
| 6,523,739 | B2 | 2/2003 | Heeley et al. |
| 6,536,656 | B2 | 3/2003 | Auclair et al. |
| 6,631,803 | B2 | 10/2003 | Rhodes et al. |
| 6,758,337 | B2 | 7/2004 | Chargueraud et al. |
| 6,766,940 | B2 | 7/2004 | Negelen |
| 6,834,793 | B2 | 12/2004 | Sutherland |
| 6,848,573 | B2 | 2/2005 | Gould et al. |
| 6,869,009 | B2 | 3/2005 | Sutherland et al. |
| 6,899,221 | B2 | 5/2005 | Skolik et al. |
| 6,905,066 | B2 | 6/2005 | Holley |
| 6,926,193 | B2 | 8/2005 | Smalley |
| 6,945,450 | B2 | 9/2005 | Rusnock |
| 6,968,992 | B2 | 11/2005 | Schuster |
| 6,971,572 | B2 | 12/2005 | Ikeda |
| 7,007,836 | B2 | 3/2006 | Smalley |
| 7,234,596 | B2 | 6/2007 | Lebras |
| 7,296,731 | B2 | 11/2007 | Auclair et al. |
| 7,380,701 | B2 | 6/2008 | Fogle et al. |
| 7,416,109 | B2 | 8/2008 | Sutherland |
| 7,427,010 | B2 | 9/2008 | Sutherland |
| 7,472,791 | B2 | 1/2009 | Spivey, Sr. |
| 7,601,111 | B2 | 10/2009 | Sutherland et al. |

(56) References Cited

U.S. PATENT DOCUMENTS

| | | | | |
|---|---|---|---|---|
| 7,699,215 | B2 | 4/2010 | Spivey, Sr. | |
| 7,743,944 | B2 | 6/2010 | Ho Fung et al. | |
| 7,743,968 | B2 | 6/2010 | Theelen | |
| 7,748,603 | B2 | 7/2010 | Fogle et al. | |
| 7,757,933 | B2 | 7/2010 | Dunn | |
| 7,793,779 | B2 | 9/2010 | Spivey, Sr. et al. | |
| 7,806,314 | B2 | 10/2010 | Sutherland | |
| 8,191,761 | B2 | 6/2012 | Brand | |
| 8,459,533 | B2 | 6/2013 | Requena et al. | |
| 8,740,051 | B2 * | 6/2014 | Gonzalez | 229/117.14 |
| 2003/0213263 | A1 | 11/2003 | Woog | |
| 2004/0050917 | A1 | 3/2004 | Smalley | |
| 2004/0074954 | A1 | 4/2004 | Fogle et al. | |
| 2004/0256445 | A1 | 12/2004 | Merzeau | |
| 2004/0262374 | A1 | 12/2004 | Chargueraud | |
| 2005/0056658 | A1 | 3/2005 | Spivey | |
| 2005/0087592 | A1 | 4/2005 | Schuster | |
| 2005/0167476 | A1 * | 8/2005 | Ikeda | 229/117.13 |
| 2005/0167478 | A1 | 8/2005 | Holley, Jr. | |
| 2006/0071058 | A1 | 4/2006 | Spivey, Sr. | |
| 2006/0169755 | A1 | 8/2006 | Spivey, Sr. | |
| 2006/0273143 | A1 | 12/2006 | Finch | |
| 2007/0039846 | A1 | 2/2007 | Spivey, Sr. | |
| 2007/0051781 | A1 | 3/2007 | Holley, Jr. | |
| 2007/0108261 | A1 | 5/2007 | Schuster | |
| 2007/0164091 | A1 | 7/2007 | Fogle et al. | |
| 2007/0181658 | A1 | 8/2007 | Sutherland | |
| 2007/0205255 | A1 | 9/2007 | Dunn | |
| 2007/0284424 | A1 | 12/2007 | Holley | |
| 2007/0295789 | A1 | 12/2007 | Ho Fung | |
| 2008/0083820 | A1 | 4/2008 | Walling et al. | |
| 2008/0099544 | A1 | 5/2008 | Skolik | |
| 2008/0119344 | A1 | 5/2008 | Sutherland et al. | |
| 2009/0236408 | A1 | 9/2009 | Spivey, Sr. | |
| 2009/0255983 | A1 | 10/2009 | De Paula et al. | |
| 2010/0108747 | A1 | 5/2010 | Brand | |
| 2010/0213249 | A1 | 8/2010 | Requena et al. | |

FOREIGN PATENT DOCUMENTS

| | | |
|---|---|---|
| DE | 85 14 718.4 | 6/1985 |
| DE | 296 07 374 | 4/1996 |
| DE | 201 12 228 | 11/2002 |
| DE | 2004 018 649 | 4/2005 |
| EP | 341 089 | 11/1989 |
| EP | 0 412 226 | 2/1991 |
| EP | 0 473 266 | 3/1992 |
| EP | 1 518 792 | 3/2005 |
| EP | 1 612 157 | 1/2006 |
| FR | 1 494 239 | 9/1967 |
| FR | 2 579 175 | 9/1986 |
| JP | 06-032320 | 4/1994 |
| JP | 8-503187 | 4/1996 |
| JP | 2005-507831 | 3/2005 |
| KR | 20-0356729 | 7/2004 |
| WO | WO 94/10047 | 5/1994 |
| WO | WO 96/27538 | 9/1996 |
| WO | WO 99/28207 | 6/1999 |
| WO | WO 00/78618 | 12/2000 |
| WO | WO 01/66434 | 9/2001 |
| WO | WO 03/037742 | 5/2003 |
| WO | WO 2005/080218 | 9/2005 |
| WO | WO 2005/123532 | 12/2005 |
| WO | WO 2007/089282 | 8/2007 |
| WO | WO 2010/014438 | 2/2010 |

* cited by examiner

CARTON WITH HANDLE

CROSS REFERENCE TO RELATED APPLICATION

This application claims the benefit of U.S. Provisional Application No. 61/633,709, filed Feb. 16, 2012, which is incorporated herein by reference in its entirety.

BACKGROUND OF THE DISCLOSURE

The present disclosure generally relates to cartons for holding containers. More specifically, the present disclosure relates to a carton having a handle.

SUMMARY OF THE DISCLOSURE

In one aspect, the disclosure is generally directed to a carton for containing a plurality of articles. The carton comprises a plurality of panels that extend at least partially around an interior of the carton. The plurality of panels comprises a first top panel, a second top panel, a bottom panel, a first side panel, and a second side panel. At least one of the first side panel and the second side panel having a curved edge. The first top panel and the second top panel are at least partially overlapped to form a top wall of the carton. At least two end flaps are respectively foldably attached to respective panels of the plurality of panels. The end flaps at least partially form a closed end of the carton and comprise a first top end flap foldably connected to the first top panel and a second top end flap foldably connected to the second top panel. A handle comprises a first handle panel and a second handle panel. The first handle panel comprises a central portion in the first top panel and an end portion in the first top end flap. The second handle panel comprises at least a portion of the second top end flap. The end portion of the first handle panel is attached to the second handle panel. At least one of the first top end flap and the second top end flap form a rounded corner at the curved edge.

In another aspect, the disclosure is generally directed to a blank for forming a carton. The blank comprises a plurality of panels comprising a first top panel, a second top panel, a bottom panel, a first side panel, and a second side panel. At least one of the first side panel and the second side panel having a curved edge. At least two end flaps are respectively foldably attached to respective panels of the plurality of panels. The at least two end flaps are for being overlapped with respect to one another to at least partially for a closed end of the carton erected from the blank. The at least two end flaps comprise a first top end flap foldably connected to the first top panel and a second top end flap foldably connected to the second top panel. Handle features for forming a handle in a carton erected from the blank comprise a first handle panel and a second handle panel. The first handle panel comprises a central portion in the first top panel and an end portion in the first top end flap. The second handle panel comprises at least a portion of the second top end flap. The end portion of the first handle panel is for attachment to the second handle panel when the blank is formed into the carton. At least one of the first top end flap and the second top end flap is configured to form a rounded corner at the curved edge when the blank is formed into the carton.

In another aspect, the disclosure is generally directed to a method of assembling a carton. The method comprises obtaining a blank comprising a plurality of panels. The plurality of panels comprises a first top panel, a second top panel, a bottom panel, a first side panel, a second side panel, a first handle panel, and a second handle panel. At least one of the first side panel and the second side panel having a curved edge. A first top end flap is foldably connected to the first top panel. A second top end flap is foldably connected to the second top panel. The first handle panel comprises a central portion in the first top panel and an end portion in the first top end flap. The second handle panel comprises at least a portion of the second top end flap. The method comprises forming a top wall of the carton by at least partially overlapping the first top panel and the second top panel. The forming the top wall comprises forming a handle. The forming the handle comprises attaching the end portion of the first handle panel to the second handle panel. The method comprises overlapping the first top end flap and the second top end flap to at least partially form a closed end of the carton and form a rounded corner at the curved edge.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., aluminum beverage cans) as disposed within the carton embodiments. In this specification, the terms "lower," "bottom," "upper" and "top" indicate orientations determined in relation to fully erected and upright cartons.

Figure 1:
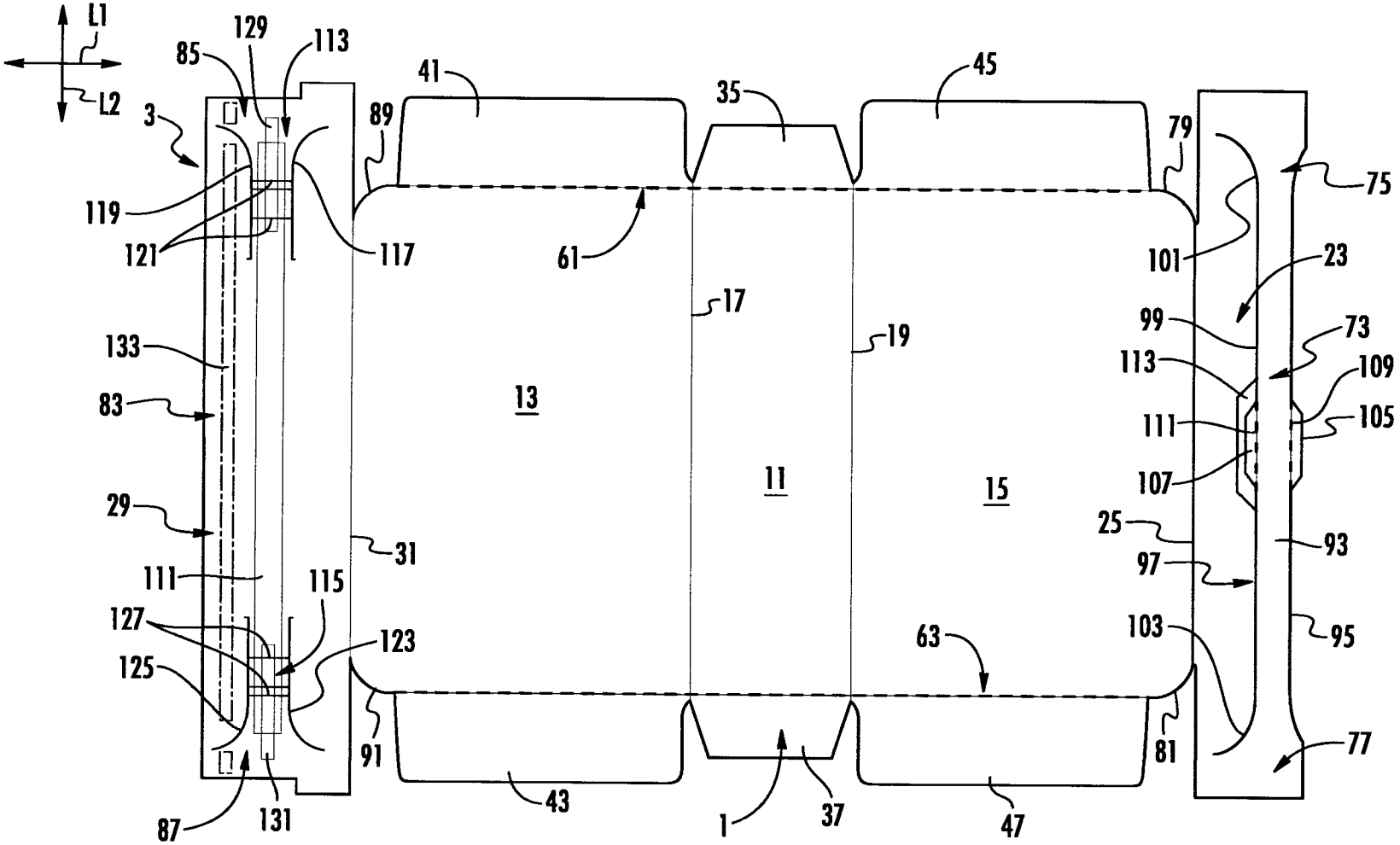
FIG. 1 is a plan view of the exterior surface of a blank of the first embodiment.
Figure 2:
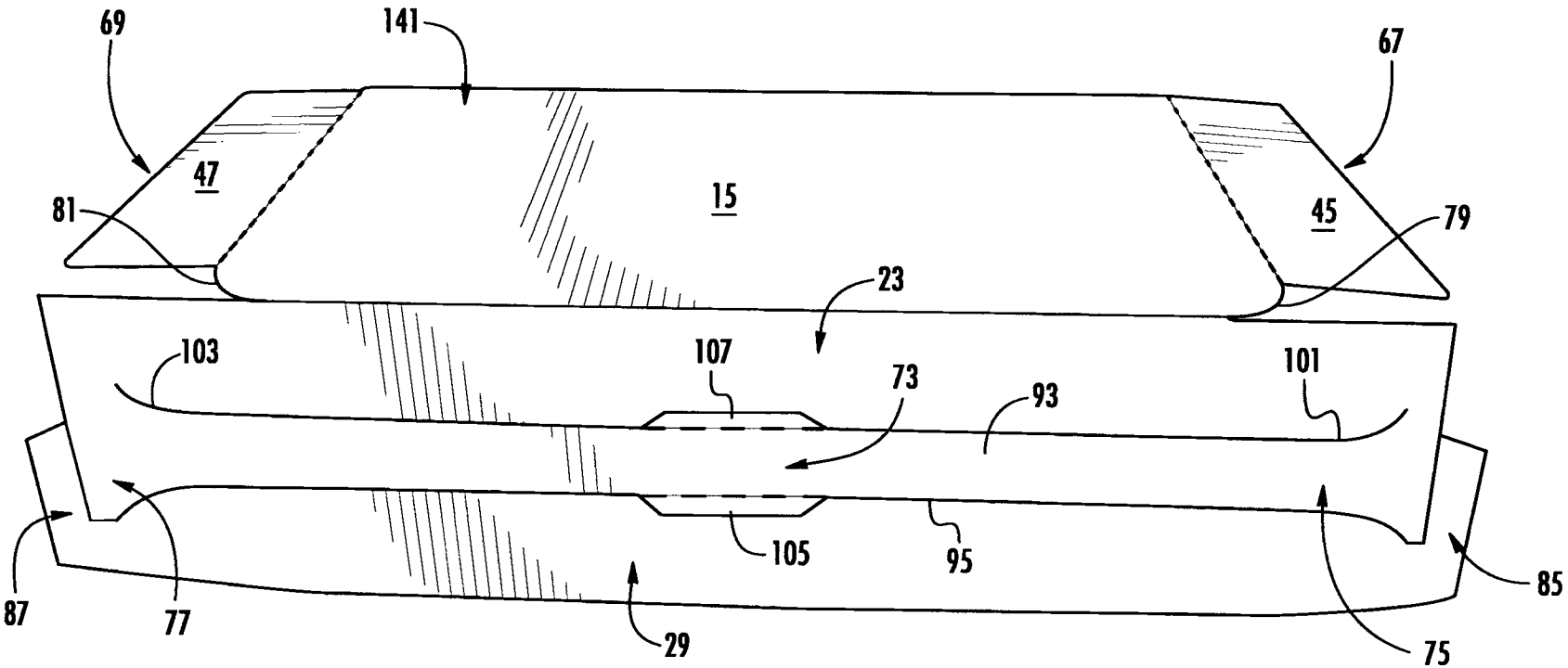
FIG. 2 is a top perspective view of a partially formed carton formed from the blank of FIG. 1.
Figure 3:
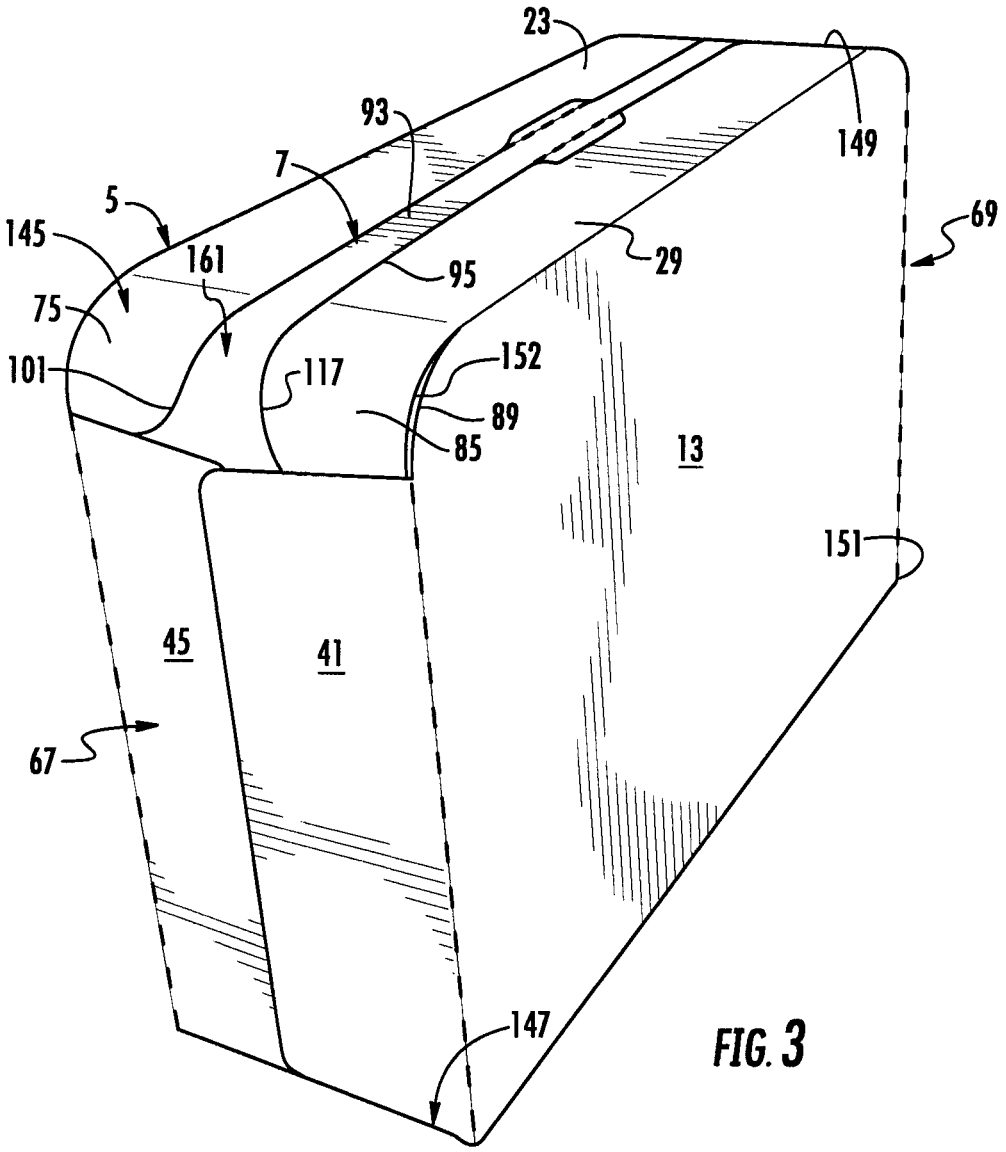
FIGS. 3-6 are perspective views of a carton formed from the blank of FIG. 1 according to one embodiment of the disclosure.
Figure 4:
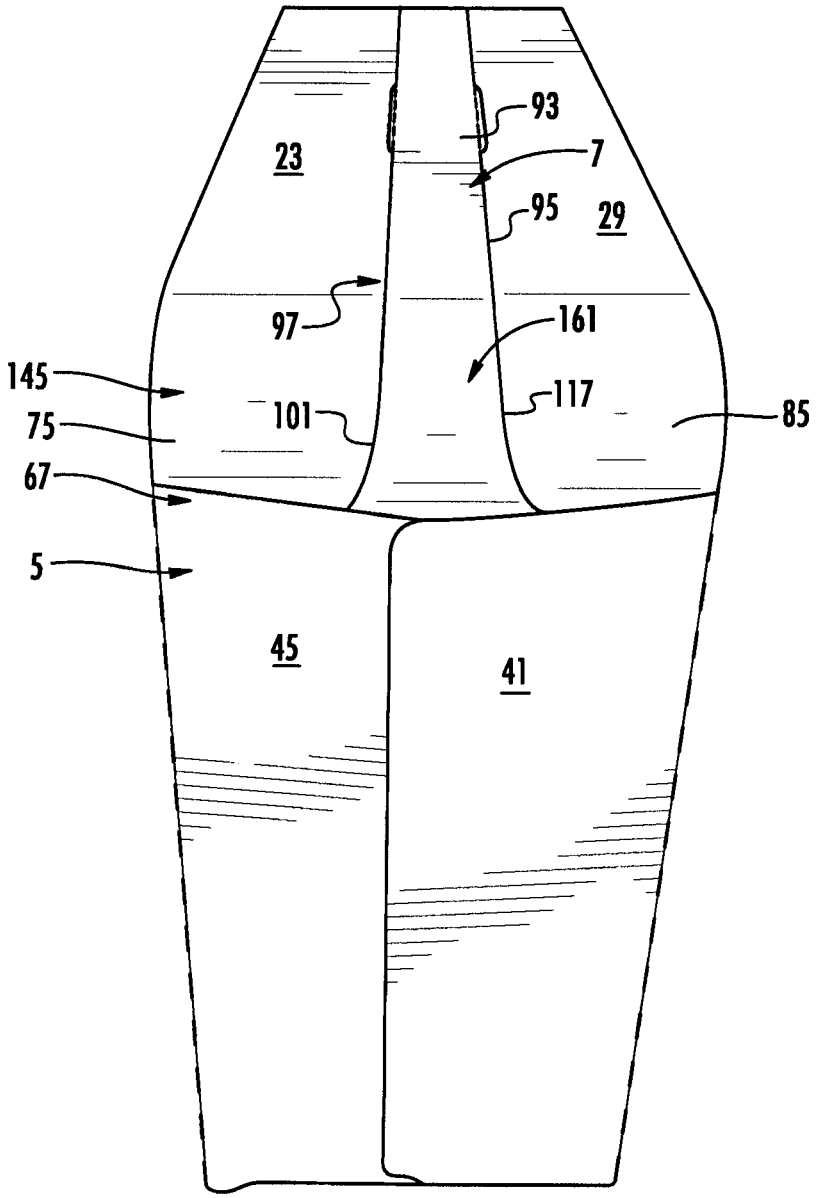
Figure 5:
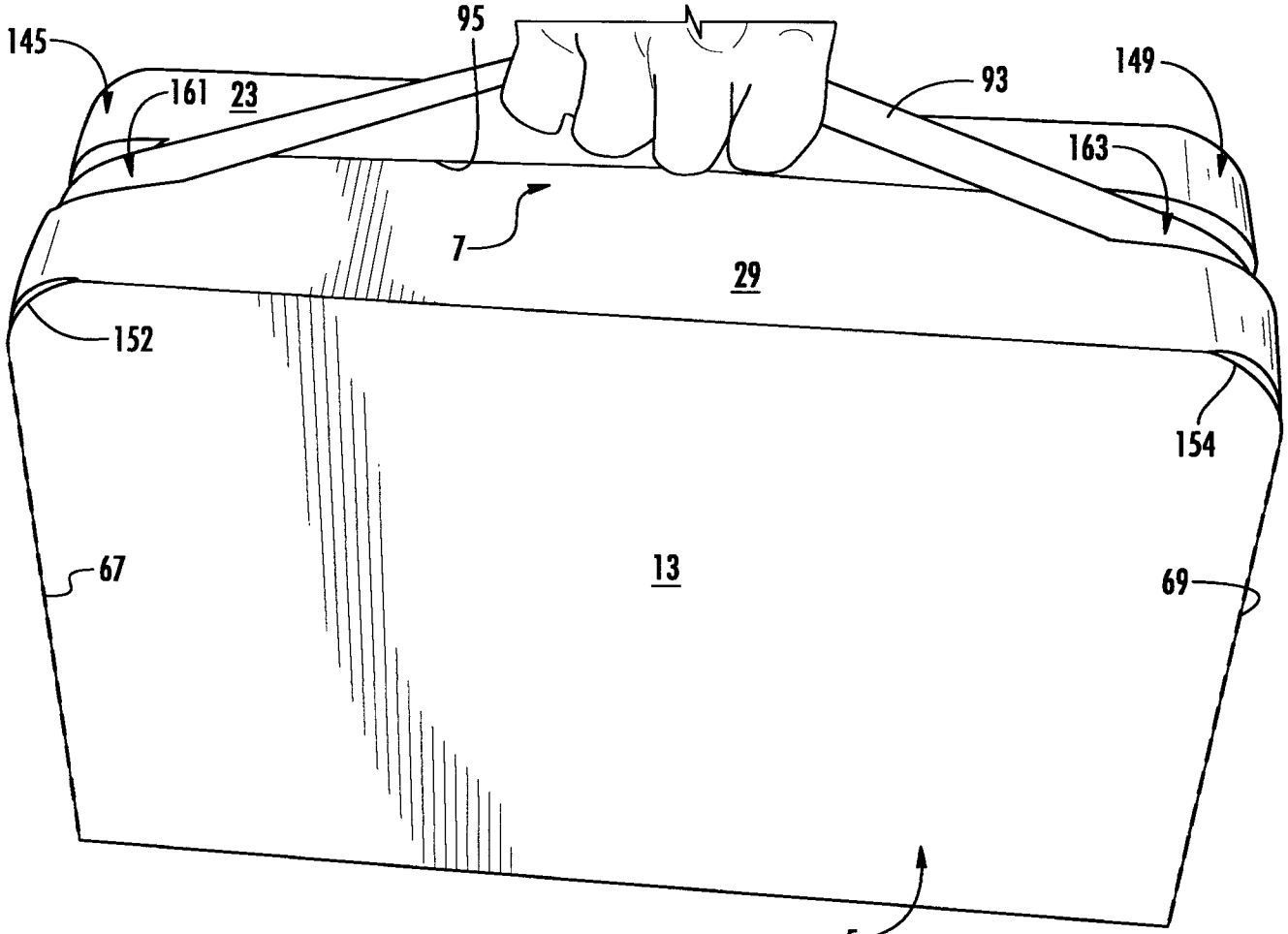
Figure 6:
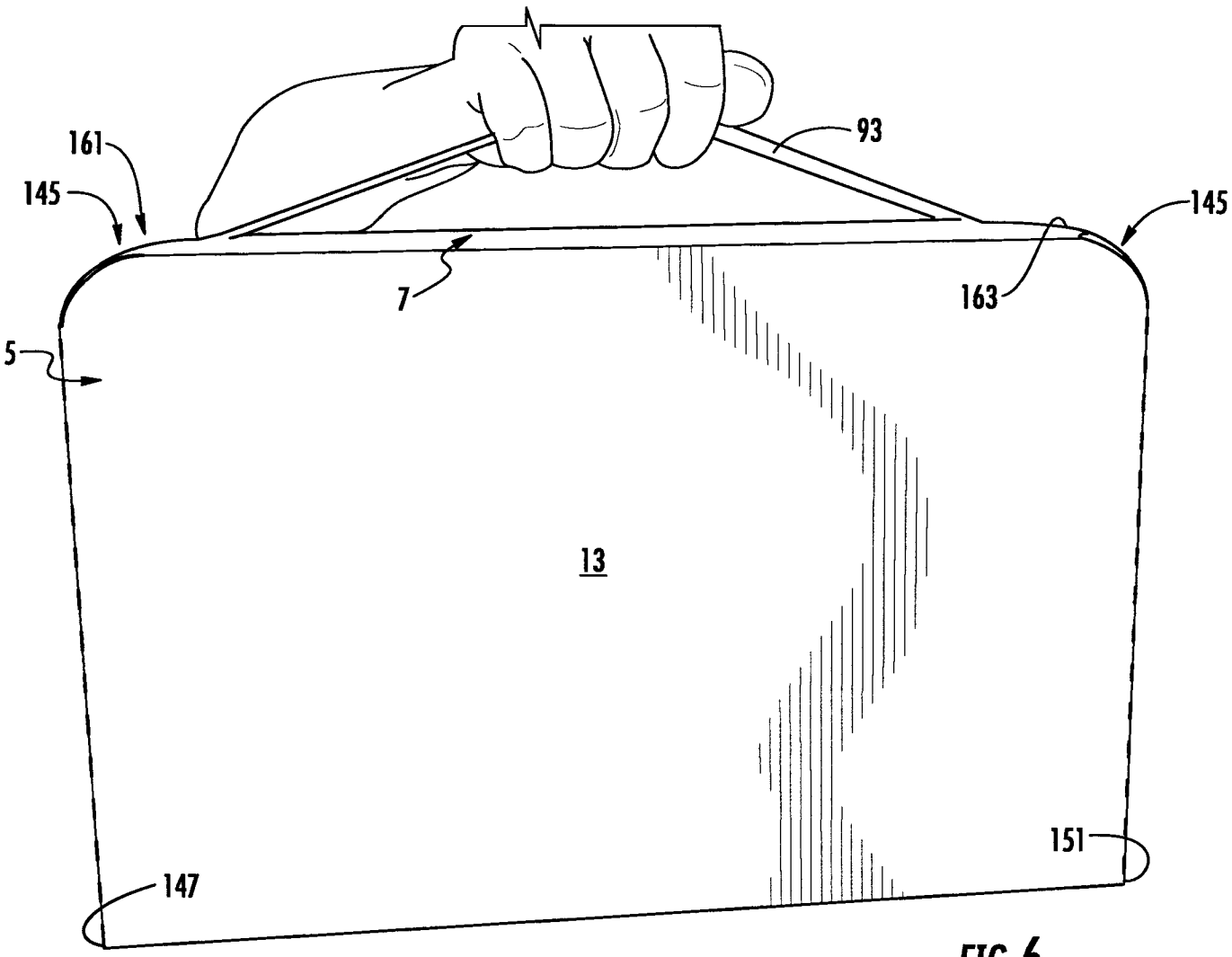
Figure 7:
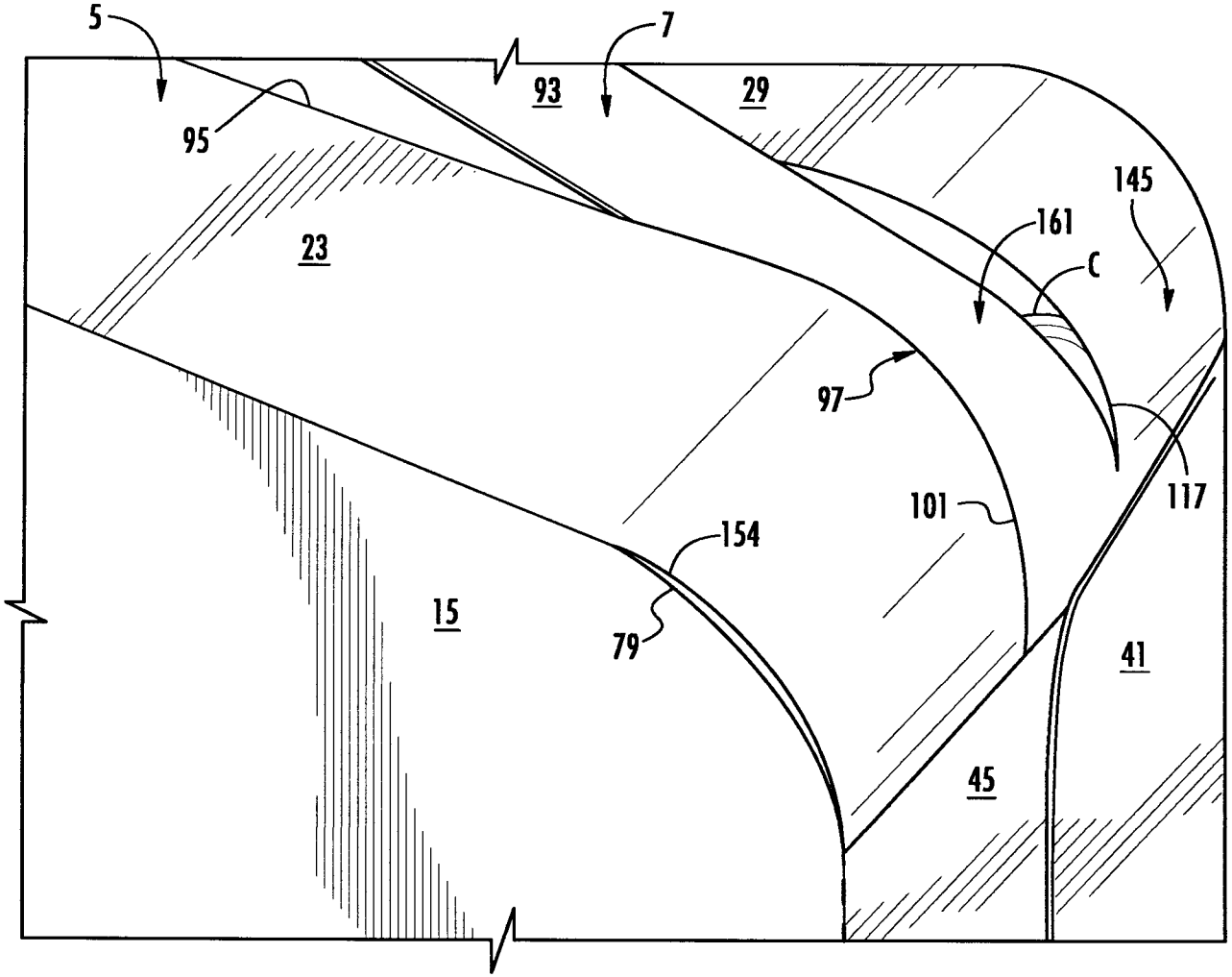
FIG. 7 is a detailed view of the top corner of the carton formed from the blank of FIG. 1.

FIG. 1 is a plan view of the exterior side 1 of a blank, generally indicated at 3, used to form a carton 5 (FIG. 3)

according to a first exemplary embodiment of the disclosure. The carton 5 can be used to house a plurality of articles such as containers C (FIG. 7). The carton 5 has a handle, generally indicated at 7 (FIGS. 3-7), for grasping and carrying the carton. In one illustrated embodiment, the carton 5 is sized to house twenty-four containers in one layer in a 4×6 arrangement, but it is understood that the carton may be sized and shaped to hold containers of a different or same quantity in a single layer, more than one layer, and/or in different row/column arrangements (e.g., 1×6, 3×6, 3×5×2, 2×6, 5×6, 2×6×2, 3×4×2, 2×9, etc.). In the illustrated embodiment, the containers C are cans, but other types of containers (e.g., bottles) can be used in the carton 5 without departing from the disclosure.

The blank 3 has a longitudinal axis L1 and a lateral axis L2. The blank 3 comprises a bottom panel 11 foldably connected to first and second side panels 13, 15 at respective lateral fold lines 17, 19, a first top panel 23 foldably connected to the second side panel 15 at a lateral fold line 25, and a second top panel 29 foldably connected to the first side panel 13 at a lateral fold line 31. The first and second top panels 23, 29 will at least partially overlap in the erected carton 5.

The bottom panel 11 is foldably connected to a first bottom end flap 35 and a second bottom end flap 37. The first side panel 13 is foldably connected to a first side end flap 41 and a second side end flap 43. The second side panel 15 is foldably connected to a first side end flap 45 and a second side end flap 47. The end flaps 35, 41, 45 extend along a first marginal area of the blank 3, and are foldably connected at a first longitudinal fold line 61. The end flaps 37, 43, 47 extend along a second marginal area of the blank 3, and are foldably connected at a second longitudinal fold line 63. The longitudinal fold lines 61, 63 may be, for example, substantially straight, offset, or oblique at one or more locations to account for blank thickness or for other factors. When the carton 5 is erected, the end flaps 35, 41, 45 at least partially close a first end 67 of the carton, and the end flaps 37, 43, 47, close a second end 69 of the carton. In accordance with an alternative embodiment of the present invention, different flap arrangements can be used for closing the ends 67, 69 of the carton 5.

In the illustrated embodiment, the first top panel 23 has a central portion 73 that generally corresponds with the length of the lateral fold line 25 connecting the first top panel to the second side panel. A first top end flap 75 extends beyond the fold line 25 at the first marginal area of the blank 3, and a second top end flap 77 extends beyond the fold line 25 at the second marginal area of the blank. In the illustrated embodiment, the top panel 23 is free from fold lines or lines of weakening connecting the top end flaps 75, 77 to the central portion 73. However, the top end flaps 75, 77 could be foldably connected to the first top panel 23 by fold lines or other lines of weakening without departing from the disclosure.

In one embodiment, the second side panel 15 has a first curved edge 79 extending between the longitudinal fold line 61 and the lateral fold line 25. The second side panel 15 has a second curved edge 81 extending between the longitudinal fold line 63 and the lateral fold line 25. The first curved edge 79 is generally adjacent the first top end flap 75 and the second curved edge 81 is generally adjacent the second top end flap 77. The curved edges 79, 81 could be otherwise shaped, arranged, and/or configured without departing for the disclosure.

In one embodiment, the second top panel 29 has a central portion 83 that generally corresponds with the length of the lateral fold line 31 connecting the second top panel 29 to the first side panel 13. A first top end flap 85 extends beyond the fold line 31 at the first marginal area of the blank 3, and a second top end flap 87 extends beyond the fold line 31 at the second marginal area of the blank. In the illustrated embodiment, the top panel 29 is free from fold lines or lines of weakening connecting the top end flaps 85, 87 to the central portion 83. However, the top end flaps 85, 87 could be foldably connected to the second top panel 29 by fold lines or other lines of weakening without departing from the disclosure.

In one embodiment, the first side panel 13 has a first curved edge 89 extending between the longitudinal fold line 61 and the lateral fold line 31. The first side panel 13 has a second curved edge 91 extending between the longitudinal fold line 63 and the lateral fold line 31. The first curved edge 89 is generally adjacent the first top end flap 85 and the second curved edge 91 is generally adjacent the second top end flap 87. The curved edges 89, 91 could be otherwise shaped, arranged, and/or configured without departing for the disclosure.

As shown in FIG. 1, the features that comprise the handle 7 include a first handle portion 93 that is in the first top panel 23. In one embodiment, the first handle portion 93 is defined by a lateral edge 95 of the first top panel 23 and a tear line 97 spaced apart from the lateral edge. The tear line 97 has a central portion 99 in the central portion 73 of the first top panel 23, a first end portion 101 in the first top end flap 75, and a second end portion 103 in the second top end flap 77. In one embodiment, the handle features include two comfort flaps 105, 107 foldably connected to the first handle portion 93 at respective lateral fold lines 109, 111. The lateral fold line 109 is generally collinear with the lateral edge 95 and the lateral fold line 111 is generally collinear with the central portion 99 of the tear line 97. Alternatively, the comfort flaps 105, 107 and fold lines 109, 111 could be otherwise shaped, arranged, configured, and/or omitted without departing from the disclosure. An access opening 113 in the first top panel 23 is adjacent the comfort flap 107.

As shown in FIG. 1, the central portion 99 of the tear line is generally straight and is parallel to at least a portion of the lateral edge 95. In one embodiment, the first end portion 101 of the tear line 97 is curved and extends from the central portion 99 of the tear line and terminates in the first top end flap 75. Similarly, the second end portion 103 of the tear line 97 is curved and extends from the central portion 99 of the tear line and terminates in the second top end flap 77. In one embodiment, the first and second end portions 101, 103 of the tear line 97 are spaced apart from a respective marginal end edge of the first and second top end flaps 75, 77. The first and second portions 101, 103 of the tear line 97 could be otherwise shaped, arranged, and configured (e.g., the first and second ends portions could be straight, or the first and second end portions could extend to the marginal edge of the first or second top end flaps 75, 77) without departing from the disclosure. The first top panel 23 could be otherwise shaped, arranged, and/or configured without departing from the disclosure.

In one embodiment, the second top panel 29 includes a second handle portion in the form of reinforcement tape 111 extending across the central portion 83 of the second top panel and into the first top end flap 85 and the second top end flap 87. The reinforcement tape 111 can be adhesively applied to the exterior surface of the second top panel 29 and the top end flaps 85, 87. Alternatively, the reinforcement tape 111 could be applied to the interior surface of the first top panel 23 and or top end flaps 75, 77 without departing from the disclosure. Alternatively, the reinforcement tape 111 can be replaced by adhesive such as glue or other reinforcing material. Further, the reinforcement tape 111 could be omitted without departing from this disclosure.

The second top panel 29 further includes a third handle portion 113 and a fourth handle portion 115. The third handle portion 113 is formed by two spaced apart tear lines 117, 119 that extend from the central portion 83 of the second top panel 29 into the first top end flap 85. In one embodiment, a plurality of lateral fold lines 121 extend across the width of the third handle portion 113 extending between the tear lines 117, 119. The fourth handle portion 115 is similarly shaped as the third handle portion 113 and is at least partially defined by two spaced apart tear lines 123, 125 extending from the central portion 83 of the second top panel 29 into the second top end flap 87. A plurality of lateral fold lines 127 extend across the width of the fourth handle portion 115 extending between the tear lines 123, 125.

In one embodiment the tear lines 117, 119, 123, 125 have generally curved end portions in respective top end flaps 85, 87. As shown in FIG. 1, glue or adhesive 129 is placed across an end of the reinforced tape 111 that overlays the third handle portion 113. Similarly glue 131 is placed across a second end of the reinforced tape 111 that overlays the fourth handle portion 115. Glue 133 is applied to the exterior surface of the second top panel 29 adjacent to the reinforced tape 111 that extends across the central portion 83 of the second top panel and into the first top end flap 85 and the second top end flap 87. In one embodiment, the glue 133 is free from contact with the second handle portion 111. Alternatively, the glue 129, 131, 133 could be applied or omitted without departing for the disclosure.

An exemplary method of erecting the carton 5 from the blank 3 is discussed in detail below and shown in FIGS. 2-7. At various stages of the erecting process, glue or other adhesive can be applied to various portions of the blank 3. Prior to the folding or forming steps, the reinforcement tape 111 can be placed on the second top panel 29 and top end flaps 85, 87 as indicated in FIG. 1. Next, the blank 3 is folded about fold lines 17, 19, 25, 31 so that the first top panel 23 overlaps the second top panel 29 to form the generally open-ended sleeve 141 shown in FIG. 2. The adhesive 133 secures the first top panel 23 to the second top panel and the adhesive 129 adheres the first handle portion 93 to the second handle portion 111 (e.g., reinforcement tape) and the third handle portion 113. The adhesive 131 adheres the first handle portion 93 to the second handle portion 111 and the fourth handle portion 115. Respective first end top flaps 75, 85 are overlapped and adhered and respective second top end flaps 77, 87 are overlapped and adhered. Articles such as beverage containers C can be inserted into the open-ended sleeve prior to closing the ends 67, 69. Alternatively, one of the ends 67, 69 can be closed prior to inserting the beverage containers C into the carton 5.

In one embodiment, the first end 67 has a rounded top corner 145 and a orthogonal bottom corner 147. Similarly, the second end 69 has a rounded top corner 149 and a orthogonal bottom corner 151. The first end 67 can be closed by folding the overlapped first top end flaps 75, 85 to be in contact with, or closely adjacent to, the respective curved edges 79, 89 of the first and second side panels 13, 15 to form the rounded top corner 145. Further, the overlapped first end flaps 75, 85 can be in contact with a respective container C that is located at the rounded top corner 145 of the carton 5. Alternatively, the overlapped first end flaps 75, 85, can be closely adjacent to the container C at the corner 145. As shown in FIG. 3, openings 152 can be located at the rounded top corner 145 between the overlapped first top end flaps 75, 85 and the respective curved edges 79, 89. Similarly, openings 154 can be located at the rounded top corner 149 between the overlapped end top flaps 77, 87 and the respective curved edges 81, 91. The bottom end flap 35 is folded to partially form the orthogonal bottom corner. After folding the overlapped first top end flaps 75, 85 and the bottom end flap 35, the side end flaps 41, 45 are folded to overlap the overlapped first top end flaps and the bottom end flap forming the closed first end 67. The closed second end 69 is formed in a similar manner as described above for the first end 67, with the overlapped second end flaps 77, 87 cooperating with the curved edges 81, 91 of the side panels 13, 15 to form the rounded top corner 97, and the end flaps 37, 43, 47 cooperating to close the second end. The first and second ends 67, 69 could be closed by other folding or positioning steps, or the ends could be otherwise shaped (e.g., having top and bottom rounded corners) without departing from the disclosure.

In one embodiment shown in FIGS. 3-7, the handle 7 is activated by grasping the overlapped and adhered first handle portion 93 and second handle portion 111. Alternatively, the second handle portion (e.g., reinforcement tape 111) can be omitted. The first handle portion 93 can be grasped at the comfort flaps 105, 107 of the central portion 73 of the first top panel 23 and the first handle portion can be lifted to separate the first handle portion from the first top panel at the tear line 97. The lifting of the first handle portion 93 causes further tearing of the tear line 97 in the top end flap 75, 77. Furthermore, the third handle portion 113 is adhered to the first handle portion 93 and the lifting of the first handle portion separates the third handle portion from the second top panel 29 and the top end flap 85 at the tear lines 117, 119. Further, the lifting of the first handle portion 93 separates the fourth handle portion 115 from the second top panel 29 and the top end flap 87 at the tear lines 123, 125. The grasping of the first handle portion 93 and lifting of the carton 5 causes the adhered first handle portion and third handle portion 113 at the first end 145 to move inwardly toward the interior of the carton. Similarly, the adhered first handle portion 93 and fourth handle portion 115 at the second end 149 of the carton 5 move inwardly toward the interior of the carton. In this way, the adhered first handle portion 93 and third handle portion 113 form a first end 161 of the handle 7, and the adhered first handle portion and fourth handle portion 115 form a second end 163 of the handle. The ends 161, 163 of the handle 7 are pulled inwardly and contact the containers C at the respective rounded corners 145, 149 of the carton. When the carton 5 is carried at the handle 7, the ends 161, 163 of the handle press against the containers C at the respective rounded corners 145, 149 such that the containers are compressed, allowing the first handle portion 93 to flex upwardly when being grasped.

The handle 7 could have other features and could otherwise be shaped, arranged, configured, and/or activated without departing from the disclosure.

Figure 8:
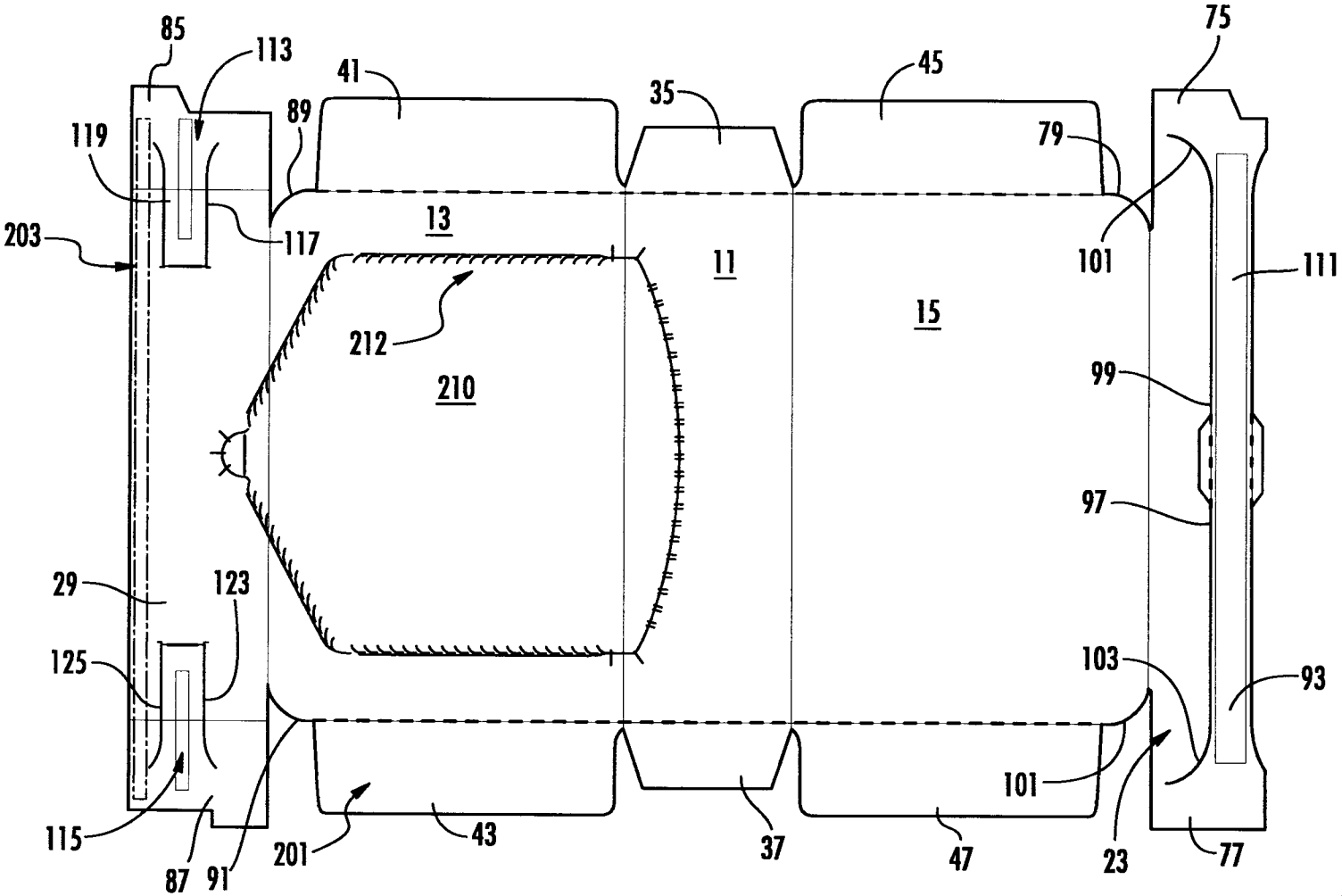
FIG. 8 is a plan view of the exterior of a blank for forming a carton according to a second embodiment of the disclosure.

FIG. 8 shows an exterior surface 201 of a blank 203 for forming a carton according to a second embodiment of the disclosure. Like or similar reference numbers are used to indicate like or similar features between the first and second embodiments. In the embodiment of FIG. 8, the blank 203 includes a dispenser panel 210 defined by a tear line 212. In one embodiment, the dispenser panel 210 is in at least a portion of the second top panel 29, the first side panel 13, and the bottom panel 11. In the embodiment of FIG. 8, the reinforcement tape 111 is attached to the underside of the first handle panel 23. When the first top panel 23 and the second top panel 29 are overlapped, the reinforcement tape 111 or second handle portion partially overlaps the third handle portion 113 and fourth handle portion 115 in the second top panel. The blank 203 could be otherwise shaped, arranged, configured, or could have other features without departing from the disclosure.

Any of the features of the various embodiments of the disclosure can be combined with, replaced by, or otherwise configured with other features of other embodiments of the disclosure without departing from the scope of this disclosure. Further, it is noted that the handle features and stress-relief areas of the various embodiments can be incorporated into a carton having any carton style or panel configuration. The carton styles and panel configurations described above are included by way of example.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

The above embodiments may be described as having one or more panels adhered together by glue. The term "glue" is intended to encompass all manner of adhesives commonly used to secure carton panels or flaps in place.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be a continuous slit penetrating a portion of the thickness of the material or penetrating the entire thickness of the material, or the like. For example, a cut line can be a continuous slit or could be wider than a slit without departing from the present disclosure.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extend at least partially around an interior of the carton, the plurality of panels comprises a first top panel, a second top panel, a bottom panel, a first side panel, and a second side panel, at least one of the first side panel and the second side panel having a curved edge, the first top panel and the second top panel being at least partially overlapped to form a top wall of the carton;

at least two end flaps respectively foldably attached to respective panels of the plurality of panels, the at least two end flaps at least partially form a closed end of the carton, and comprise a first top end flap foldably connected to the first top panel and a second top end flap foldably connected to the second top panel; and a handle comprising a first handle panel and a second handle panel, the first handle panel comprises a central portion in the first top panel and an end portion in the first top end flap, the second handle panel comprises at least a portion of the second top end flap, the end portion of the first handle panel being attached to the second handle panel, and at least one of the first top end flap and the second top end flap form a rounded corner at the curved edge, and the curved edge and at least one of the first top end flap and the second top end flap form the rounded corner adjacent at least one of the top wall and the closed end of the carton and the first handle panel at least partially overlaps the second handle panel at the rounded corner of the carton.

2. The carton of claim 1, wherein the second handle panel comprises a first portion in the second top panel and a second portion in the second top end flap, the central portion of the first handle being attached to the first portion of the second handle panel.

3. The carton of claim 1, wherein the curved edge is a first curved edge of the first side panel and the carton further comprises a second curved edge of the second side panel.

4. The carton of claim 3, wherein the first curved edge and the second curved edge cooperate with the first top panel, the second top panel, the first top end flap, and the second top end flap to form the rounded corner.

5. The carton of claim 4, wherein the first top end flap and the second top end flap are overlapped to at least partially form the closed end, the overlapped first and second top end flap being downwardly folded and adjacent the first curved edge and the second curved edge at the rounded corner.

6. The carton of claim 3, wherein the at least two end flaps comprise a first side end flap foldably connected to the first side panel and a second side end flap foldably connected to the second side panel, the first curved edge extends from the first side end flap to the second top end flap and the second curved edge extends from the second side end flap to the first top end flap.

7. The carton of claim 6, wherein the first side end flap, the second side end flap, and a bottom end flap foldably connected to the bottom panel cooperate to form an orthogonal corner at the closed end.

8. The carton of claim 7, wherein the orthogonal corner is a lower corner of the closed end and the rounded corner is an upper corner of the closed end.

9. The carton of claim 1, wherein the handle further comprises reinforcement tape reinforcing the handle and adhesively attaching the first handle panel and the second handle panel.

10. The carton of claim 9, wherein the reinforcement tape is in face-to-face contact with the central portion of the first handle panel.

11. The carton of claim 10, wherein the reinforcement tape is in face-to-face contact with the end portion of the first top end flap and the at least a portion of the second top end flap of the second handle panel so that the reinforcement tape forms at least a portion of the rounded corner.

12. The carton of claim 1, wherein the first handle panel is at least partially defined by a tear line that comprises a central portion in the first top panel that at least partially defines the central portion of the first handle panel, and a second portion in the first top end flap that at least partially defines the end portion of the first handle panel.

13. The carton of claim 12, wherein the first handle panel is at least partially defined by an edge of the first top panel, the tear line being spaced apart from the edge.

14. The carton of claim 13, wherein the central portion of the tear line is generally parallel to the edge of the first top panel, and the second portion of the tear line comprises an oblique portion that extends from the central portion and a curved portion that extends from the oblique portion.

15. The carton of claim 1, wherein the carton has a dispenser comprising a dispenser panel removably attached to at least one of the panels, the dispenser panel being at least partially defined by a tear line and being for forming an opening for selective removal of articles from the package.

16. A carton for containing a plurality of articles, the carton comprising:

a plurality of panels that extend at least partially around an interior of the carton, the plurality of panels comprises a first top panel, a second top panel, a bottom panel, a first side panel, and a second side panel, at least one of the first side panel and the second side panel having a curved edge, the first top panel and the second top panel being at least partially overlapped to form a top wall of the carton;

at least two end flaps respectively foldably attached to respective panels of the plurality of panels, the at least two end flaps at least partially form a closed end of the carton, and comprise a first top end flap foldably connected to the first top panel and a second top end flap foldably connected to the second top panel; and a handle comprising a first handle panel and a second handle panel, the first handle panel comprises a central portion in the first top panel and an end portion in the first top end flap, the second handle panel comprises at least a portion of the second top end flap, the end portion of the first handle panel being attached to the second handle panel, and at least one of the first top end flap and the second top end flap form a rounded corner at the curved edge, and the second handle panel is at least partially defined by two spaced-apart tear lines, the two spaced-apart tear lines each comprise a first portion in the second top panel and a second portion in the second top end flap, the second portion of each of the spaced-apart tear lines comprises an oblique portion that extends from a respective first portion and a curved portion that extends from a respective oblique portion.

17. The carton of claim 16, wherein the second handle panel comprises a plurality of fold lines that extend between the two spaced-apart tear lines.

18. A blank for forming a carton comprising:

a plurality of panels comprising a first top panel, a second top panel, a bottom panel, a first side panel, and a second side panel, at least one of the first side panel and the second side panel having a curved edge;

at least two end flaps respectively foldably attached to respective panels of the plurality of panels, the at least two end flaps are for being overlapped with respect to one another to at least partially for a closed end of the carton erected from the blank, the at least two end flaps comprise a first top end flap foldably connected to the first top panel and a second top end flap foldably connected to the second top panel; and handle features for forming a handle in a carton erected from the blank, the handle features comprise a first handle panel and a second handle panel, the first handle panel comprises a central portion in the first top panel and an end portion in the first top end flap, the second handle panel comprises at least a portion of the second top end flap, the end portion of the first handle panel being for attachment to the second handle panel when the blank is formed into the carton, and at least one of the first top end flap and the second top end flap being configured to form a rounded corner at the curved edge when the blank is formed into the carton, wherein the second handle panel is at least partially defined by two spaced-spaced apart tear lines, the two spaced-apart tear lines each comprise a first portion in the second top panel and a second portion in the second top end flap, the second portion of each of the spaced-apart tear lines comprises an oblique portion that extends from a respective first portion and a curved portion that extends from a respective oblique portion, and the second handle panel comprises a plurality of fold lines that extend between the two spaced-apart tear lines.

19. The blank of claim 18, wherein the first handle panel is configured to at least partially overlap the second handle panel at the rounded corner when the blank is formed into the carton.

20. The blank of claim 18, wherein the curved edge is a first curved edge of the first side panel and the blank further comprises a second curved edge of the second side panel.

21. The blank of claim 20, wherein the first curved edge and the second curved edge cooperate with the first top panel, the second top panel, the first top end flap, and the second top end flap to form the rounded corner when the blank is formed into the carton.

22. The blank of claim 21, wherein the at least two end flaps comprise a first side end flap foldably connected to the first side panel and a second side end flap foldably connected to the second side panel.

23. The blank of claim 22, wherein the first curved edge extends from the first side end flap to the second top end flap and the second curved edge extends from the second side end flap to the first top end flap.

24. The blank of claim 22, wherein the first side end flap, the second side end flap, and a bottom end flap foldably attached to the bottom panel cooperate to form an orthogonal corner at the closed end in the carton formed from the blank.

25. The blank of claim 18, wherein the handle features further comprises reinforcement tape for adhesively connecting the first handle panel and the second handle panel.

26. The blank of claim 25, wherein the reinforcement tape is for being in face-to-face contact with the central portion of the first handle panel.

27. The blank of claim 18, wherein the first handle panel is at least partially defined by a tear line that comprises a central portion in the first top panel that at least partially defines the central portion of the first handle panel, a second portion in the first top end flap that at least partially defines the end portion of the first handle panel, and an edge of the first top panel, the tear line being spaced apart from the edge.

28. A blank for forming a carton comprising:

a plurality of panels comprising a first top panel, a second top panel, a bottom panel, a first side panel, and a second side panel, at least one of the first side panel and the second side panel having a curved edge;

at least two end flaps respectively foldably attached to respective panels of the plurality of panels, the at least two end flaps are for being overlapped with respect to one another to at least partially for a closed end of the carton erected from the blank, the at least two end flaps comprise a first top end flap foldably connected to the first top panel and a second top end flap foldably connected to the second top panel; and handle features for forming a handle in a carton erected from the blank, the handle features comprise a first handle panel and a second handle panel, the first handle panel comprises a central portion in the first top panel and an end portion in the first top end flap, the second handle panel comprises at least a portion of the second top end flap, the end portion of the first handle panel being for attachment to the second handle panel when the blank is formed into the carton, and at least one of the first top end flap and the second top end flap being configured to form a rounded corner at the curved edge when the blank is formed into the carton, wherein the handle features further comprises reinforcement tape for adhesively connecting the first handle panel and the second handle panel, the reinforcement tape is for being in face-to-face contact with the central portion of the first handle panel and for being in face-to-face contact with the end portion of the first top end flap and the at least a portion of the second top end flap of the second handle panel so that the reinforcement tape forms at least a portion of the rounded corner in the carton formed from the blank.

29. A method of assembling a carton comprising:

obtaining a blank comprising a plurality of panels comprising a first top panel, a second top panel, a bottom panel, a first side panel, a second side panel, at least one of the first side panel and the second side panel having a curved edge, a first handle panel, a second handle panel, the blank comprises a first top end flap foldably connected to the first top panel, and a second top end flap foldably connected to the second top panel, the first handle panel comprises a central portion in the first top panel and an end portion in the first top end flap, the second handle panel comprises at least a portion of the second top end flap, the second handle panel is at least partially defined by two spaced-apart tear lines, each of the tear lines comprises a first portion in the second top panel and a second portion in the second end flap;

forming a top wall of the carton by at least partially overlapping the first top panel and the second top panel, the forming the top wall comprises forming a handle, the forming the handle comprises attaching the end portion of the first handle panel to the second handle panel;

overlapping the first top end flap and the second top end flap, and the first handle panel and the second handle panel to at least partially form a closed end of the carton and form a rounded corner adjacent at least one of the top wall and the closed end of the carton at the curved edge, forming the handle further comprises separating the second handle panel from the first top panel and the second top end flap by tearing along the two spaced-apart tear lines.

30. The method of claim 29, wherein forming the rounded corner comprises folding the overlapped first top end flap and the second top end flap to conform to the contour of the curved edge.

31. The method of claim 30, wherein the blank comprises a first side end flap foldably connected to the first side panel, and a second side end flap foldably connected to the second side panel, the forming the closed end comprises at least partially overlapping the first side end flap and the second side end flap.

32. The method of claim 31, wherein the curved edge is a first curved edge of the first side panel and the blank further comprises a second curved edge of the second side panel.

33. The method of claim 32, wherein forming the rounded corner comprises folding the overlapped first top end flap and the second top end flap to conform to the contour of the first curved edge and the second curved edge.

34. The method of claim 31, where in the blank comprises a bottom end flap foldably connected to the bottom panel, the forming the closed end comprises positioning the first side end flap, the second side end flap, and the bottom end flap to form an orthogonal corner at the closed end.

35. The method of claim 34, wherein the orthogonal corner is a lower corner of the closed end and the rounded corner is an upper corner of the closed end.

36. The method of claim 29, wherein closing the end comprises applying adhesive to at least one of the first top end flap and the second top end flap.

37. The method of claim 29, wherein the blank comprises dispenser features comprising at least one dispenser panel at least partially defined by a tear line extending in at least one of the top panel, the first side panel, and the second side panel, the method further comprises forming a dispenser opening by at least partially removing the dispenser panel.

38. The method of claim 29, wherein forming the handle comprises positioning reinforcement tape to adhesively attach the first handle panel and the second handle panel.

39. A method of assembling a carton comprising:

obtaining a blank comprising a plurality of panels comprising a first top panel, a second top panel, a bottom panel, a first side panel, a second side panel, at least one of the first side panel and the second side panel having a curved edge, a first handle panel, a second handle panel, the blank comprises a first top end flap foldably connected to the first top panel, and a second top end flap foldably connected to the second top panel, the first handle panel comprises a central portion in the first top panel and an end portion in the first top end flap, the second handle panel comprises at least a portion of the second top end flap;

forming a top wall of the carton by at least partially overlapping the first top panel and the second top panel, the forming the top wall comprises forming a handle, the forming the handle comprises attaching the end portion of the first handle panel to the second handle panel;

overlapping the first top end flap and the second top end flap to at least partially form a closed end of the carton and form a rounded corner at the curved edge, wherein the first handle panel is at least partially defined by a tear line that comprises a central portion of the first top panel that at least partially defines the central portion of the first handle panel, and a second portion in the first top end flap that at least partially defines the end portion of the first handle panel, the forming the handle comprises separating the first handle panel from the first top panel and the first top end flap by tearing along the tear line.

* * * * *